US009375892B2

(12) United States Patent
Nagahara

(10) Patent No.: US 9,375,892 B2
(45) Date of Patent: Jun. 28, 2016

(54) LABEL PRODUCTION APPARATUS AND LABEL PRODUCTION METHOD

(71) Applicant: SEIKO EPSON CORPORATION, Tokyo (JP)

(72) Inventor: Atsushi Nagahara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 14/220,520

(22) Filed: Mar. 20, 2014

(65) Prior Publication Data

US 2014/0295055 A1 Oct. 2, 2014

(30) Foreign Application Priority Data

Mar. 28, 2013 (JP) ..... 2013-068823

(51) Int. Cl.

| | |
|---|---|
| ***B05D 3/12*** | (2006.01) |
| ***B31D 1/02*** | (2006.01) |
| ***B41J 3/407*** | (2006.01) |
| ***B41J 11/66*** | (2006.01) |

(52) U.S. Cl.

CPC ..... *B31D 1/021* (2013.01); *B31D 1/027* (2013.01); *B41J 3/4075* (2013.01); *B41J 11/663* (2013.01); *B41J 11/666* (2013.01)

(58) Field of Classification Search

CPC ..... B41J 11/00; B41J 11/66; B41J 11/663; B41J 11/666

USPC ..... 347/104; 156/384, 387

See application file for complete search history.

(56) References Cited

U.S. PATENT DOCUMENTS

| | | | | |
|---|---|---|---|---|
| 7,959,251 | B2 * | 6/2011 | Furukawa | B41J 2/2142 347/19 |
| 2002/0168212 | A1 * | 11/2002 | Nedblake, Jr. | B41J 11/0015 400/621 |
| 2011/0061802 | A1 * | 3/2011 | Raming | G09F 3/0288 156/256 |
| 2013/0181396 | A1 * | 7/2013 | Liu | B65H 29/62 271/283 |

FOREIGN PATENT DOCUMENTS

| | | |
|---|---|---|
| JP | 2007-293658 | 11/2007 |
| JP | 2007-295222 | 11/2007 |
| JP | 2010-149333 | 7/2010 |

* cited by examiner

*Primary Examiner* — Kelly M Gambetta

(74) *Attorney, Agent, or Firm* — Workman Nydegger

(57) ABSTRACT

A label production apparatus includes: a printing unit; a test unit; and a post-process unit configured to cut a material in accordance with test results by the test unit. In the stated label production apparatus, each of a label images includes a common image portion and a changeable image portion. Further, in the label production apparatus, the post-process unit cuts a first base material using a first cut-line, the common image portion and the changeable image portion of a label image that has been detected to have no print defect, whereas the post-process unit cuts the first base material using a second cut-line for not cutting out the common image portion from the first base material but cutting out from the first base material at least part of the changeable image portion of a label image that has been detected to have a print defect.

3 Claims, 11 Drawing Sheets

LABEL PRODUCTION APPARATUS AND LABEL PRODUCTION METHOD

BACKGROUND

1. Technical Field

The present invention relates to label production apparatuses and label production methods.

2. Related Art

For example, well known are label production apparatuses that are configured to form images (label images) such as pictures, figures, symbols (characters), bar codes, and the like on a print target medium in which a mount, an adhesive layer, and a base material are laminated in sequence. Such a label production apparatus includes a printing unit for printing images on the base material and a post-process unit for cutting a portion of the base material and adhesive layer where the images are printed. After the cutting, an unnecessary portion, that is, a portion other than the image is separated from the mount (hereinafter, this separation is also called "unused portion removal" or "scrap removal").

Such a label production apparatus is proposed that includes a test unit for testing label images printed on a medium and cuts out only non-defective label images from the medium so as to remove the defectively printed label images together with a unnecessary portion of the medium through the unused portion removal (for example, see JP-A-2010-149333).

It is to be noted that in a label production apparatus, a plurality of label images each of which has an image portion common to the plurality of label images (common image portion) and an image portion that differs depending on each of the plurality of label images (changeable image portion, hereinafter also referred to as "variable image portion"), are printed (variable printing) in some case.

To a position from which a defectively printed label image has been separated by the above-mentioned unused portion removal, an operator pastes a non-defective label image while adjusting the position of the label image to be pasted.

However, in the above label production apparatus, in the case where a print defect is detected, a label image having the print defect is not cut out and is separated together with the unused portion. This has raised a problem that it is difficult for the operator to recognize a position to which a non-defective label image should be pasted at the time of label image pasting.

Further, in the case of the variable printing, because the variable image portion is also removed at the time of unused portion removal, it is necessary to print a non-defective label image including a variable image again and paste the newly printed label image. Accordingly, this pasting work needs a considerable amount of time.

SUMMARY

An advantage of some aspects of the invention is to provide a label production apparatus and a label production method so as to simplify label image pasting work and make it possible to easily recognize the positions of label images to be pasted.

A label production apparatus according to an aspect of the invention includes: a printing unit configured to print a plurality of label images on a first base material included in a print target medium that has the first base material, a second base material, and an adhesive layer interposed between the first base material and the second base material; a test unit configured to test the label images printed on the print target medium; and a post-process unit configured to cut the first base material in accordance with test results by the test unit.

In the stated label production apparatus, each of the label images includes a common image portion which is an image portion common to the plurality of label images and a changeable image portion which is an image portion that differs depending on each of the plurality of label images. Further, the post-process unit cuts the first base material using a first cut-line for cutting out, from the first base material, the common image portion and the changeable image portion of the label image that has been detected to have no print defect by the test unit, whereas the post-process unit cuts the first base material using a second cut-line for not cutting out the common image portion from the first base material but cutting out from the first base material at least part of the changeable image portion of the label image that has been detected to have a print defect by the test unit.

Other aspects of the invention will be clarified hereinafter through descriptions of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline

Figure 1:
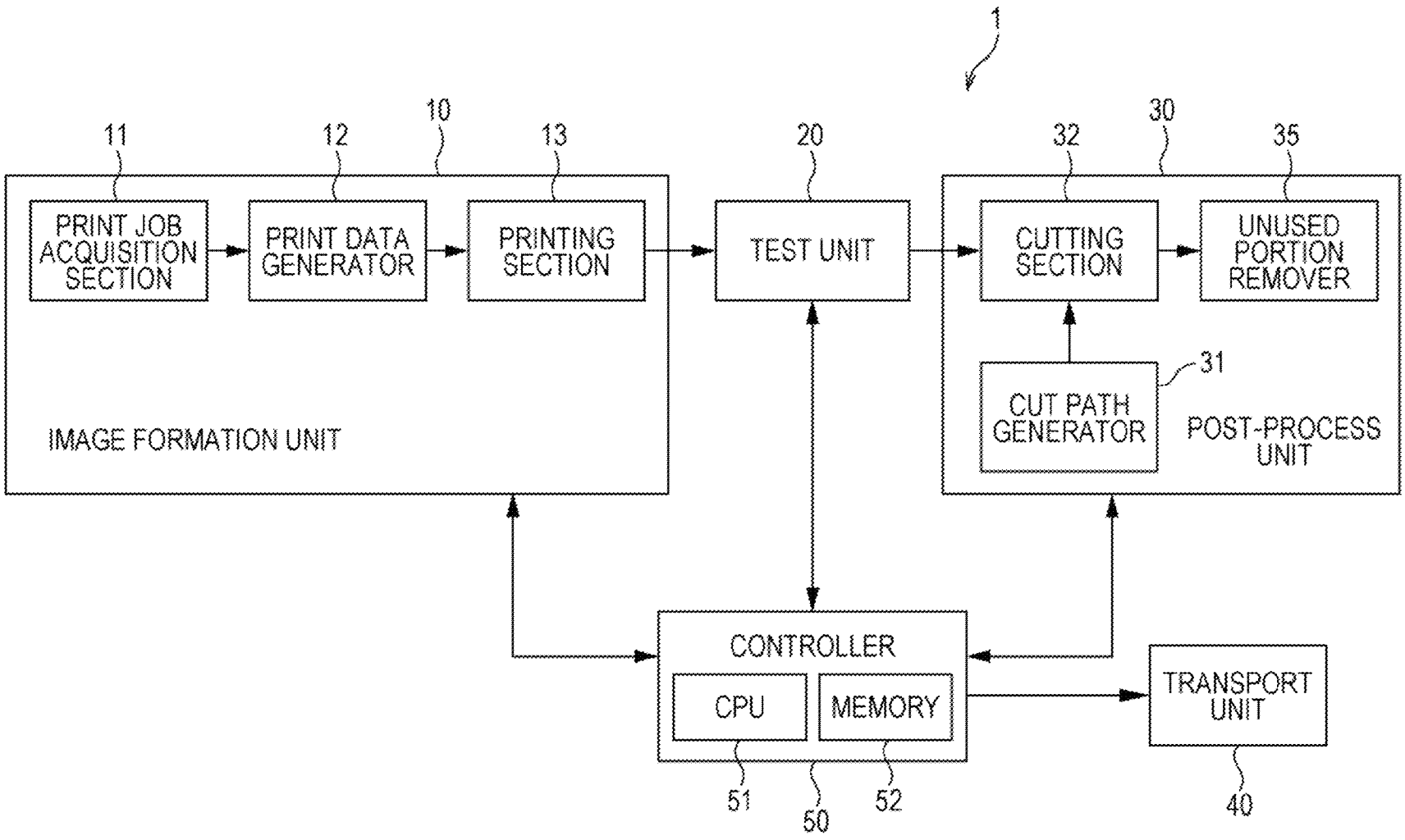
FIG. 1 is a block diagram illustrating a configuration of a label production apparatus.

At least the following will be clarified through descriptions of this specification and the drawings.

A label production apparatus including the following constituent elements will be clarified: that is, a printing unit configured to print a plurality of label images on a first base material included in a print target medium that has the first base material, a second base material, and an adhesive layer interposed between the first base material and the second base material; a test unit configured to test the label images printed on the print target medium; and a post-process unit configured to cut the first base material in accordance with test results by the test unit. In the stated label production apparatus, each of the label images includes a common image portion which is an image portion common to the plurality of label images and a changeable image portion which is an image portion that differs depending on each of the plurality of label images. Further, the post-process unit cuts the first base material using a first cut-line for cutting out, from the first base material, the common image portion and the changeable image portion of the label image that has been detected to have no print defect by the test unit, whereas the post-process unit cuts the first base material using a second cut-line for not cutting out the common image portion from the first base material but cutting out from the first base material at least part of the changeable image portion of the label image that has been detected to have a print defect by the test unit.

According to this label production apparatus, in the case where a label image is defectively printed, it is possible to make only the changeable image portion thereof remain on the second base material. Accordingly, it is possible to simplify the label image pasting work and easily recognize a position of the label image to be pasted.

In the above label production apparatus, it is preferable that each of the label images have a plurality of the changeable image portions.

According to this label production apparatus, the position for label image pasting can be more easily recognized.

In the above label production apparatus, it is preferable that the changeable image portion to be cut out from the first base material be selectable among the plurality of changeable image portions when the second cut-line is used.

According to this label production apparatus, easiness of the label image pasting work can be enhanced.

A label production method including the following processes will be clarified: that is, the method includes printing a plurality of label images on a first base material included in a print target medium that has the first base material, a second base material, and an adhesive layer interposed between the first base material and the second base material; testing the label images printed on the print target medium; and post-processing to cut the first base material in accordance with test results by the testing. In the stated label production method, each of the label images includes a common image portion which is an image portion common to the plurality of label images and a changeable image portion which is an image portion that differs depending on each of the plurality of label images. Further, the post-processing is so configured as to cut the first base material using a first cut-line for cutting out, from the first base material, the common image portion and the changeable image portion of the label image that has been detected to have no print defect by the testing, whereas the post-processing is so configured as to cut the first base material using a second cut-line for not cutting out the common image portion from the first base material but cutting out from the first base material at least part of the changeable image portion of the label image that has been detected to have a print defect by the testing.

First Embodiment

A first embodiment of the invention is given below while exemplifying a label production apparatus (hereinafter, referred to as "label production apparatus 1") configured to print images using an ink jet technique.

Figure 2:
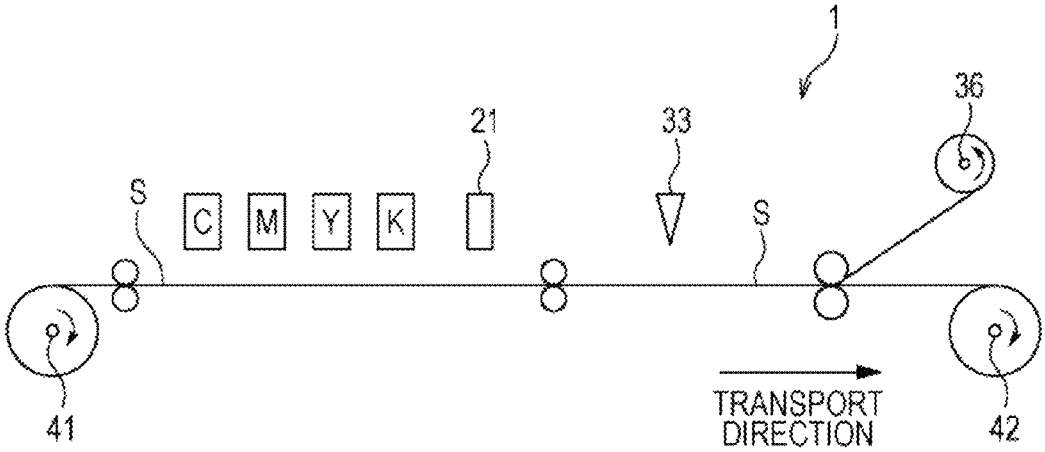
FIG. 2 is a diagram illustrating a schematic configuration of the label production apparatus.

FIG. 1 is a block diagram illustrating a configuration of the label production apparatus 1. As shown in FIG. 1, the label production apparatus 1 includes an image formation unit 10, a test unit 20, a post-process unit 30, a transport unit 40, and a controller 50. FIG. 2 shows a schematic configuration of the label production apparatus 1.

Figure 3:
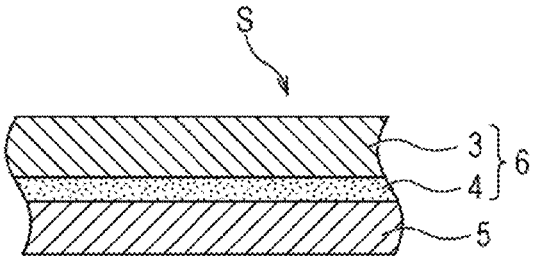
FIG. 3 is a cross-sectional view illustrating a configuration of roll paper.

In this embodiment, paper that is wound in roll form (hereinafter, referred to as "roll paper S" (continuous paper)) is used as an example of a medium (which corresponds to the print target medium) on which images are printed. FIG. 3 is a cross-sectional view illustrating a configuration of the roll paper S of this embodiment. As shown in FIG. 3, the roll paper S is configured of three layers including a base material 3 (which corresponds to the first base material), a mount 5 (which corresponds to the second base material), and an adhesive layer 4 interposed between the base material 3 and the mount 5. One surface of the base material 3 (surface on the opposite side to the adhesive layer 4) is a print surface on which images (label images) are printed. The base material 3 and the adhesive layer 4 constitute a seal member 6.

Image Formation Unit 10

The image formation unit 10 is a unit configured to print images (label images) on the roll paper S.

As shown in FIG. 1, the image formation unit 10 includes a print job acquisition section 11, a print data generator 12, and a printing section 13.

The print job acquisition section 11 acquires a print job from an input device (not shown). Data of an image to be printed, data for cutting, and so on are inputted as the print job.

The print data generator 12 generates print data in accordance with the print job acquired by the print job acquisition section 11.

The printing section 13 is a section that forms (prints) label images on the roll paper S using the print data. Note that the printing section 13 of this embodiment is a line printer including a plurality of heads which are so disposed as to face the roll paper S. To be more specific, as shown in FIG. 2, the printer has four heads including a cyan ink head C for discharging cyan ink, a magenta ink head M for discharging magenta ink, a yellow ink head Y for discharging yellow ink, and a black ink head K for discharging black ink. These four heads are disposed in series at constant intervals in the order of the cyan ink head C, magenta ink head M, yellow ink head Y, and black ink head K from the upstream side in a transport direction.

A nozzle row where a plurality of nozzles through which ink is discharged are aligned in a paper width direction, is provided in each of the heads. With this, by discharging ink from each of the heads toward the roll paper S transported in the transport direction, it is possible to form a paper width's worth of dots on the roll paper S at a time. In this manner, the printing section 13 prints the label images by discharging ink from each of the heads on the roll paper S transported in the transport direction.

Test Unit 20

The test unit 20 is a unit configured to test a label image formed on the roll paper S. The test unit 20 of this embodiment has a scanner 21. As shown in FIG. 2, the scanner 21 is disposed downstream from the heads of the image formation unit 10 in the transport direction.

The scanner 21 scans the roll paper S on which printing has been performed so as to obtain color information therefrom. Through this, the scanner 21 generates a scan image obtained by scanning the label image printed on the roll paper S.

Subsequently, the test unit 20 compares the scan image generated by the scanner 21 with the original image (image data) to test whether or not the label image was normally printed (that is, whether the image is non-defective or defective).

Post-Process Unit 30

The post-process unit 30 includes a cut path generator 31, a cutting section 32, and an unused portion remover 35.

The cut path generator 31 generates a cut-line (hereinafter, also referred to as "cut path") that is used when the seal member 6 of the roll paper S is cut in the cutting section 32. In the case where the data for cutting obtained in the print job is used as is, it is unnecessary for the cut path generator 31 to generate the cut path.

The cutting section 32 is a section configured to cut the seal member 6 of the roll paper S following the cut path. The cutting section 32 of this embodiment includes a laser cutter 33 for cutting the seal member 6 by irradiating the seal member 6 with a laser beam and an eye mark sensor (not shown) for detecting an eye mark printed on the roll paper S. The eye mark is a mark that is used to control timing when cutting is performed by the laser cutter 33.

The unused portion remover 35 is a section that includes an unused portion winding shaft 36 and is so configured as to separate an unnecessary portion of the seal member 6 (portion other than the label image) from the mount 5 of the roll paper S. As shown in FIG. 2, the unused portion winding shaft 36 is disposed downstream from the laser cutter 33 in the transport direction at a position above a transport path and rotates in response to the transport of the roll paper S so as to separate the unnecessary portion from the roll paper S.

Figure 4:
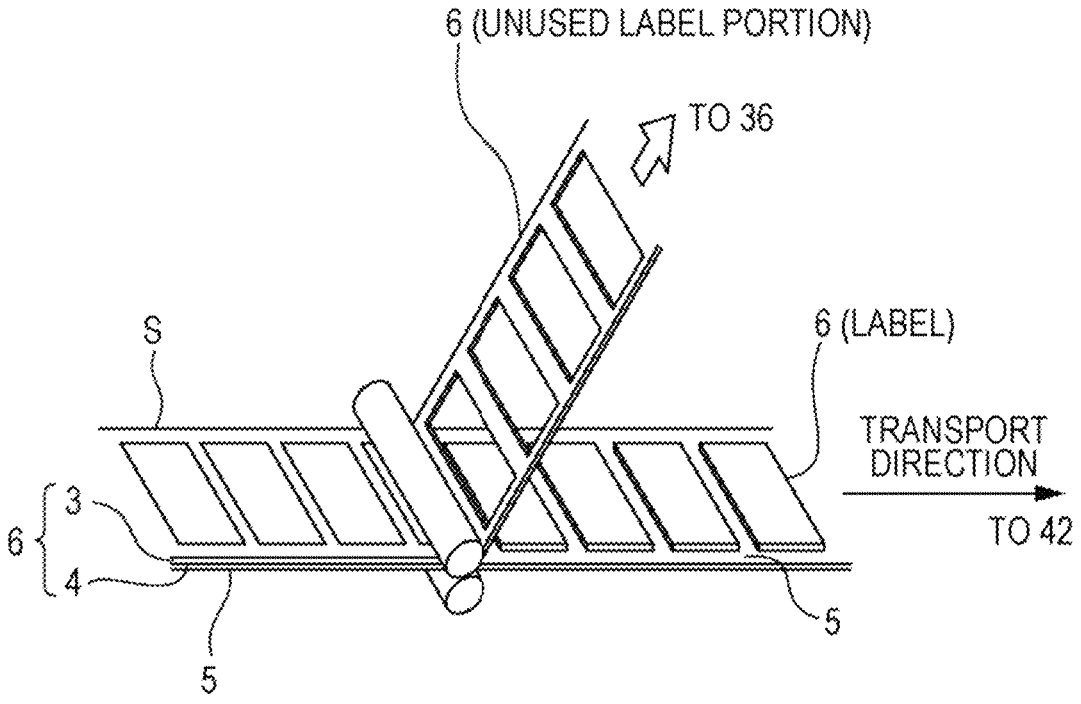
FIG. 4 is a descriptive diagram illustrating a state in which unused portion removal is being carried out.

FIG. 4 is a descriptive diagram illustrating an example of a state in which the unused portion removal is being carried out. In this example, label images each being shaped in a substantially rectangular form are printed on the roll paper S, and the perimeter of each of the label images is cut by the laser cutter 33. As shown in the drawing, an unnecessary portion of the seal member 6 (portion other than the label image) of the roll paper S having experienced the cutting is wound up (separated from the mount 5) with the unused portion winding shaft 36 so that only a portion of the seal member 6 that includes the label image is left on the mount 5.

Transport Unit 40

The transport unit 40 is a unit that includes a feed-out shaft 41 and a winding drive shaft 42 and is so configured as to transport the roll paper S in a predetermined direction (hereinafter, referred to as "transport direction").

The feed-out shaft 41 is a shaft that is so configured as to feed out the roll paper S in the transport direction and is disposed at the most upstream position in the transport direction in the transport path shown in FIG. 2.

The winding drive shaft 42 is disposed at the most downstream position in the transport direction in the transport path shown in FIG. 2, and is rotated by a motor (not shown) being driven so as to transport the roll paper S in the transport direction as well as wind up the roll paper S on which the label images have been formed.

In addition, a plurality of rollers are disposed as part of the transport unit 40 in the transport path between the feed-out shaft 41 and the winding drive shaft 42.

Controller 50

The controller 50 is so configured as to control operation of each of the units in the label production apparatus 1, and is communicably connected with each of the units via interfaces. The controller 50 includes a CPU 51 and a memory 52. The CPU 51 executes a program (which includes various drivers' processes) that drives the respective units in the label production apparatus 1. The memory 52 stores the program to be executed by the CPU 51 and various types of data.

The controller 50 controls each of the units in the label production apparatus 1 by making the CPU 51 execute the program stored in the memory 52. The controller 50 controls first the transport unit 40 to rotate the winding drive shaft 42 using the motor (not shown) so that the roll paper S is transported in the transport direction, during which the controller 50 controls the image formation unit 10, the test unit 20 and the post-process unit 30, respectively, so as to carry out the label production.

Printed Image

Figure 5:
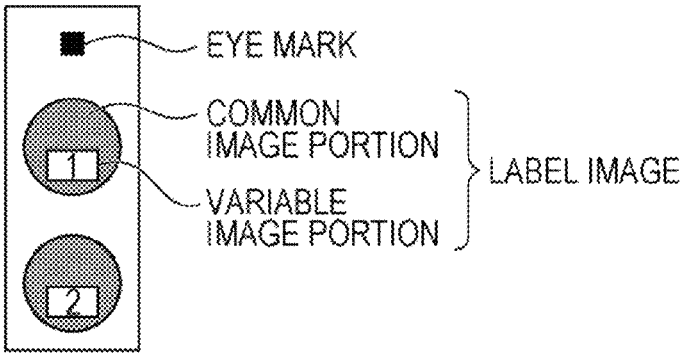
FIG. 5 is a descriptive diagram of a label image printed in a first embodiment of the invention.

FIG. 5 is a descriptive diagram of a label image printed in this embodiment.

In this embodiment, an image including an eye mark (a mark indicated by a square in black) and circular images (label images), as shown in FIG. 5, is repeatedly printed on the roll paper S. Each of the label images printed in this embodiment includes a common image portion and a variable image portion (which corresponds to the changeable image portion).

The common image portion is an image portion that is common to the plurality of label images.

The variable image portion is an image portion that differs depending on each of the plurality of label images.

For example, in the label image shown in FIG. 5, an area where a number is written is a variable image portion, while an area of the label image excluding the variable image portion is a common image portion. In the following description, of the two label images shown in FIG. 5, the one near the eye mark (on the upper side in the drawing) is called a label image in the upper stage, while the other one far from the eye mark (on the lower side in the drawing) is called a label image in the lower stage.

Operation of Label Production Apparatus

Figure 6:
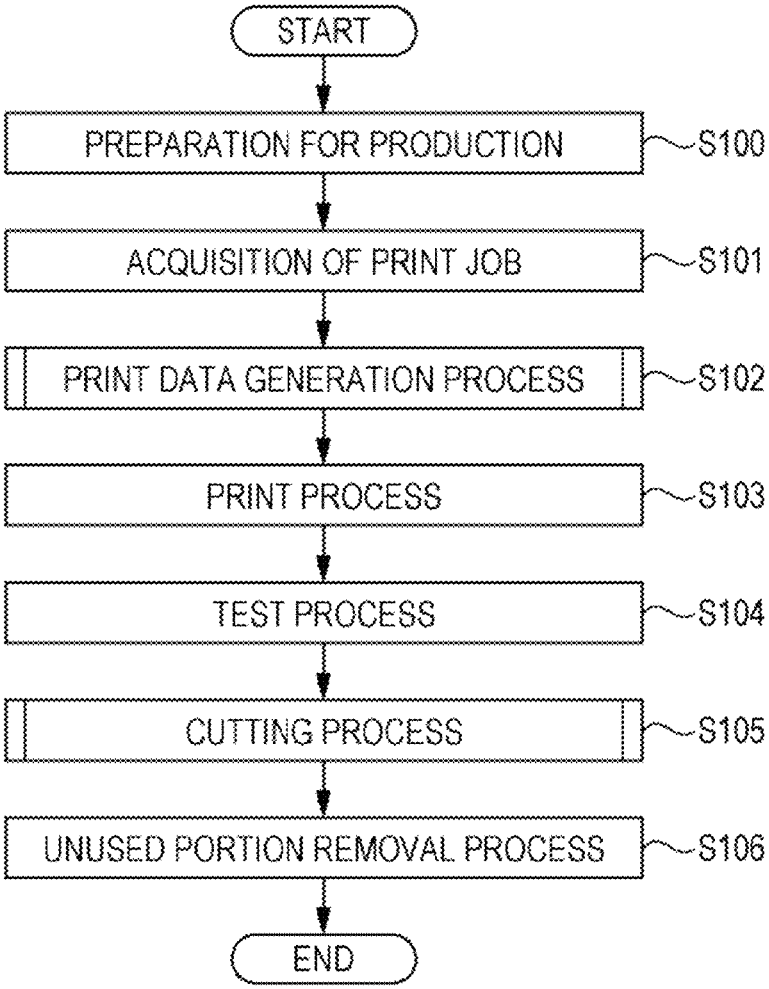
FIG. 6 is a flowchart of a label production operation of the label production apparatus.

FIG. 6 is a flowchart illustrating a label production operation of the label production apparatus 1.

First, an operator in charge of operating the label production apparatus 1 makes preparation for the production (S100). Here, the preparation for the production includes, for example, position adjustment of the sensor (eye mark detection sensor) in the cutting section 32, adjustment of operation conditions for the unused portion removal in the unused portion remover 35, and the like.

Next, the operator inputs a print job into the label production apparatus 1 using an input device (not shown). The print job acquisition section 11 of the image formation unit 10 acquires the print job (S101). The print job acquired in S101 includes image data of an image to be actually printed and cut-line data corresponding to the image data (hereinafter, cut-line data is also referred to as "cut path data"). The cut path data may be generated in the cut path generator 31 in accordance with print data.

Figure 7:
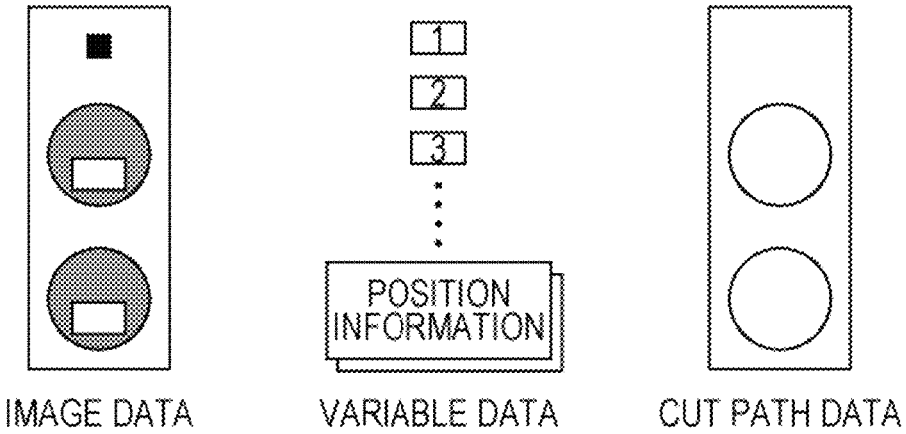
FIG. 7 is a descriptive diagram of data obtained in a print job in the first embodiment.

FIG. 7 is a descriptive diagram of data obtained in the print job in the first embodiment. As shown in FIG. 7, image data for printing an eye mark and common image portions of the label images, and cut path data for cutting the perimeter of each of the common image portions are obtained. Note that these data are bitmap data.

In addition, variable data for printing variable image portions is also obtained. In this embodiment, the variable data includes characters (1, 2, . . . ), and information indicating the values of these characters is inputted as a csv file (not shown). Further, position information that is used for arranging the variable image portions in the image data (common image portions) is also obtained. In the position information, defined are an original position, a size of height (h), a size of width (w), and the like, which are used when each of the variable image portions is arranged.

After the acquisition of the print job, the print data generator 12 carries out a process (print data generation process) in which print data for the CMYK heads to discharge the respective color inks is generated from the image data and the variable data (S102). Detailed description of the print data generation process is given hereinafter. In this embodiment, the variable data is combined with the image data based on the position information before the generation of the print data. Consequently, the image data including the variable image portions therein, as shown in FIG. 5, is generated. Thereafter, the print data generation process is carried out using the generated image data.

Figure 8:
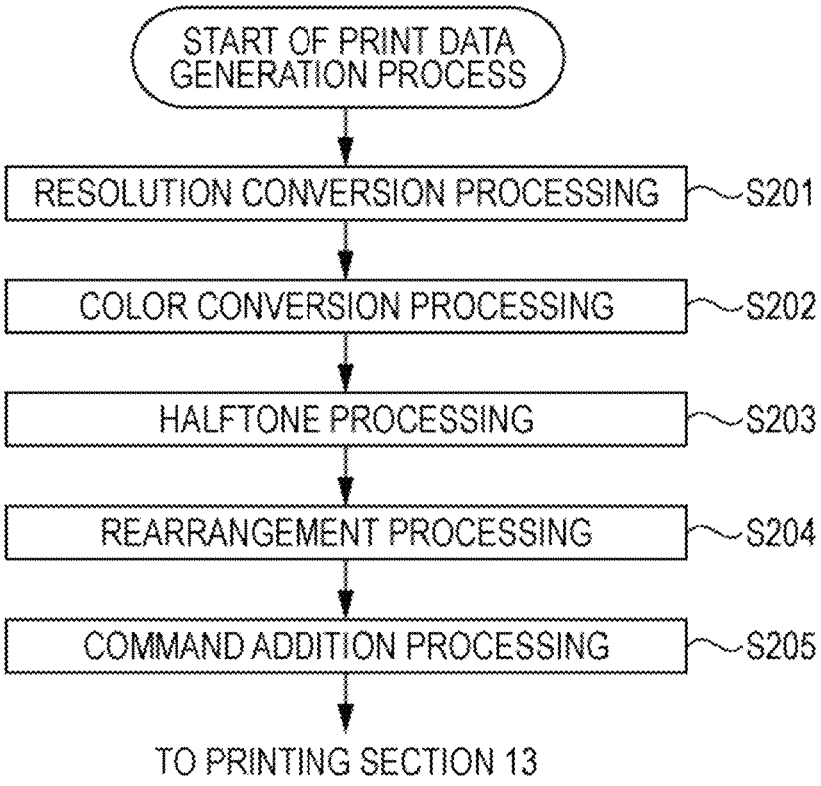
FIG. 8 is a descriptive diagram of a print data generation process.

FIG. 8 is a descriptive diagram of the print data generation process.

The print data generator 12 receives the image data from the print job acquisition section 11, converts the received image data to print data in a form that can be interpreted by the printing section 13, then outputs the print data to the printing section 13. The print data generator 12, when converting the image data to the print data, executes resolution conversion processing, color conversion processing, halftone processing, rearrangement processing, command addition processing, and so on.

The resolution conversion processing (S201) is processing in which the image data (text data, image data, and the like) is so converted as to have resolution (print resolution) with which printing is performed on paper. For example, in the case where print resolution of 720 by 720 dpi is specified, the image data is converted to bitmap-formed image data having resolution of 720 by 720 dpi. Each pixel data of the image data having experienced the resolution conversion processing is multi-tone RGB data expressed in an RGB color space (for example, 256 tones). The tone value is determined based on the RGB image data.

The color conversion processing (S202) is processing that converts the RGB data to data in a CMYK color space. The image data in the CMYK color space is data corresponding to colors of ink that the printing section 13 has. In other words, the print data generator 12 creates image data on a CMYK plane based on the RGB data.

The color conversion processing is executed based on a table in which tone values of the RGB data are related to tone values of the CMYK data. This table is called a color conversion lookup table (LUT). Note that the pixel data having experienced the color conversion processing is CMYK data of 256 tones expressed in the CMYK color space.

The halftone processing (S203) is processing that converts data of a high-tone number to data of a tone number which can be formed by the printing section 13. With this halftone processing, data indicating 256 tones is converted to one-bit data indicating two tones, two-bit data indicating four tones, or the like. One-bit pixel data or two-bit pixel data corresponds to each pixel of the image data that has experienced the halftone processing. The above pixel data is data indicating a state of dot formation at each pixel (presence/absence of dots, sizes of dots). In the case of the two-bit pixel data (four tones), for example, the pixel data is converted to four levels of dot formation; that is, no dot is formed corresponding to a dot tone value "00", a small dot is formed corresponding to a dot tone value "01", a medium dot is formed corresponding to a dot tone value "10", and a large dot is formed corresponding to a dot tone value "11". Thereafter, a dot formation ratio for each dot size is determined, then the pixel data is created, making use of dithering, γ correction, an error diffusion method, or the like, so that the dots are formed being dispersed by the printing section 13.

The rearrangement processing (S204) is processing in which the pixel data arranged in matrix form are rearranged in the order of data to be sent to the printing section 13 for each pixel data. For example, the pixel data are so rearranged as to correspond to the arrangement order of the nozzles of each head.

The command addition processing (S205) is processing that adds command data to the data having experienced the rearrangement processing in accordance with the print technique. As the command data, transport data indicating a transport speed of the medium can be cited, for example.

Through experiencing the above-described processings, the print data of CMYK colors is generated from the image data. The generated print data is sent to the printing section 13.

While controlling the transport unit 40 to transport the roll paper S in the transport direction, the controller 50 controls the printing section 13 to discharge ink from the respective heads thereof onto the roll paper S using the print data (respective CMYK print data) generated in the print data generator 12. In this manner, a print process in which the image shown in FIG. 5 is printed on the roll paper S is carried out (FIG. 6: S103). By consecutively carrying out this print process, the image shown in FIG. 5 is repeatedly printed on the roll paper S.

Subsequently, the controller 50 controls the test unit 20 to carry out a test process in which the images printed by the printing section 13 are tested (S104). First, the scanner 21 is made to scan the image printed on the roll paper S when the image passes under the scanner 21. Then, the test unit 20 tests the presence/absence of defects by comparing the scanned image data (scan data) with the image data (FIG. 5). More specifically, the test unit 20 compares the scan data with the image data for each pixel. If a difference in pixel color is less than a threshold, "OK" is determined; if the difference is equal to or greater than the threshold, "NG" is determined. In this manner, it is tested whether the printed image is non-defective or defective.

Figure 9:
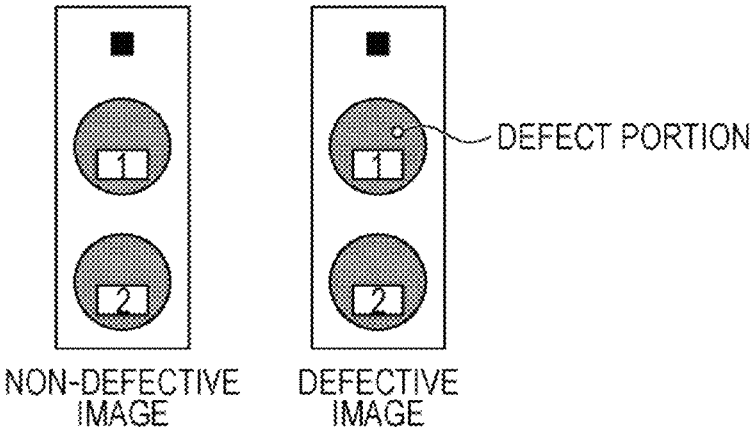
FIG. 9 is a diagram illustrating a test result.

FIG. 9 is a diagram illustrating an example of a test result. The picture on the left side in FIG. 9 shows a scan result of a non-defective image. In this picture on the left side, because there is not any portion where a difference in color exceeds the threshold when compared with the image data (FIG. 7) for each pixel, the image is determined to be non-defective. Meanwhile, the picture on the right side in FIG. 9 shows an example of a scan result of a defective image. In this picture on the right side, there is a portion where a dot is not formed (defect portion) due to a nozzle missing or the like. Therefore, because a portion where a difference in color exceeds the threshold is found when compared with the image data (FIG. 7) for each pixel, the image is determined to be defective. Note that in this embodiment, it is not tested whether the area where the variable image portion is formed is non-defective or defective. In other words, the position where the variable image portion is arranged is specified from the position information, so that the pixels present in a range of the variable image portion at the specified position are not tested.

A portion of the roll paper S that has experienced the test process in the test unit 20 is transported to the post-process unit 30. The controller 50 makes the cutting section 32 carry out a cutting process in accordance with the test result by the test unit 20 (FIG. 6: S105).

Figure 10:
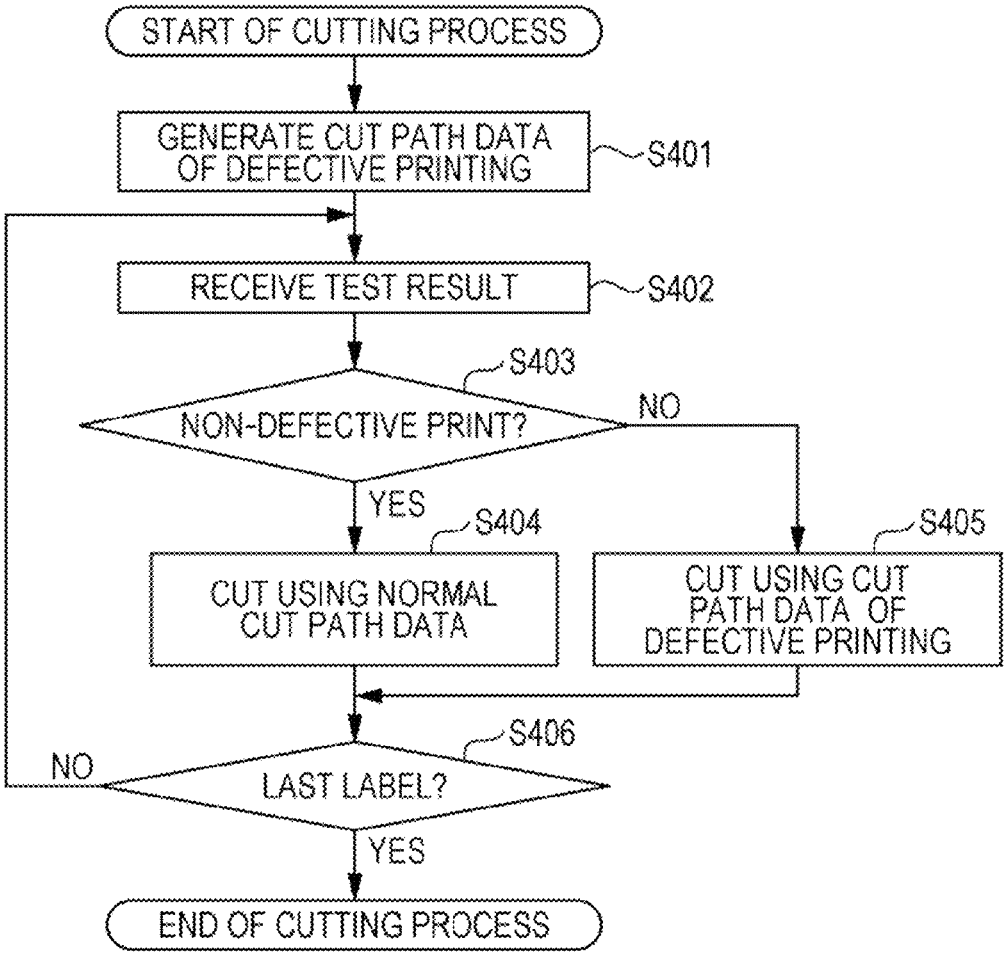
FIG. 10 is a flowchart for describing a cutting process operation in the first embodiment.

FIG. 10 is a flowchart for describing a cutting process operation in this embodiment.

The cut path generator 31 generates cut path data of defective printing based on the cut path data and the variable data (see FIG. 7) obtained in the print job (S401). Here, although the cut path of defective printing (which corresponds to the second cut-line) is generated by the cut path generator 31, the invention is not limited thereto. For example, the cut path of defective printing may be obtained beforehand as part of the print job.

Figures 11A, 11B, 11C:
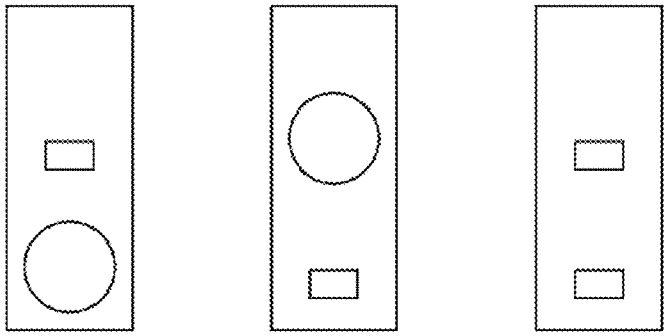
FIGS. 11A through 11C are diagrams for describing cut path data of defective printing generated in the first embodiment.

FIGS. 11A through 11C are diagrams for describing cut path data of defective printing generated in the first embodiment. As shown in the drawings, the cut path data of defective printing is such data that is generated through replacing one of the cut paths shown in FIG. 7 or both of them with a cut path or cut paths for cutting the perimeter of the variable image portions. Note that the specified position of each of the variable image portions can be obtained from the variable data (position information). FIG. 11A is a cut path of a case in which the label image in the upper stage is defective, FIG. 11B is a cut path of a case in which the label image in the lower stage is defective, and FIG. 11C is a cut path of a case in which both the label images in the upper and lower stages are defective. The cut path generator 31 of this embodiment creates the above-described three kinds of data as the cut paths of defective printing.

Then, the controller 50 receives a test result by the test unit 20 (FIG. 10: S402). If the test result indicates a non-defective print ("YES" at S403), the controller 50 makes the cutting section 32 perform cutting using normal cut paths (see FIG. 7) (S404). Meanwhile, if the test result indicates a defective print ("NO" at S403), the controller 50 makes the cutting section 32 perform cutting using a cut path of defective printing in accordance with the print defect position (see FIGS. 11A through 11C) (S405).

Thereafter, the controller 50 determines whether or not the current label is the last one (S406). If it is determined that the current label is not the last one ("NO" at S406), the process returns to step S402 so as to carry out the cutting process again. If it is determined that the current label is the last one ("YES" at S406), the cutting process is ended.

A portion of the roll paper S that has experienced the cutting process is transported to the unused portion remover 35. The controller 50 makes the unused portion remover 35 carry out an unused portion removal process (FIG. 6: S106). In the unused portion removal process, the unused portion remover 35 rotates the unused portion winding shaft 36 to separate an unused portion (unnecessary portion) of the seal member 6, which is a portion other than the label, from the mount 5 (remove the unused portion).

Figure 12:
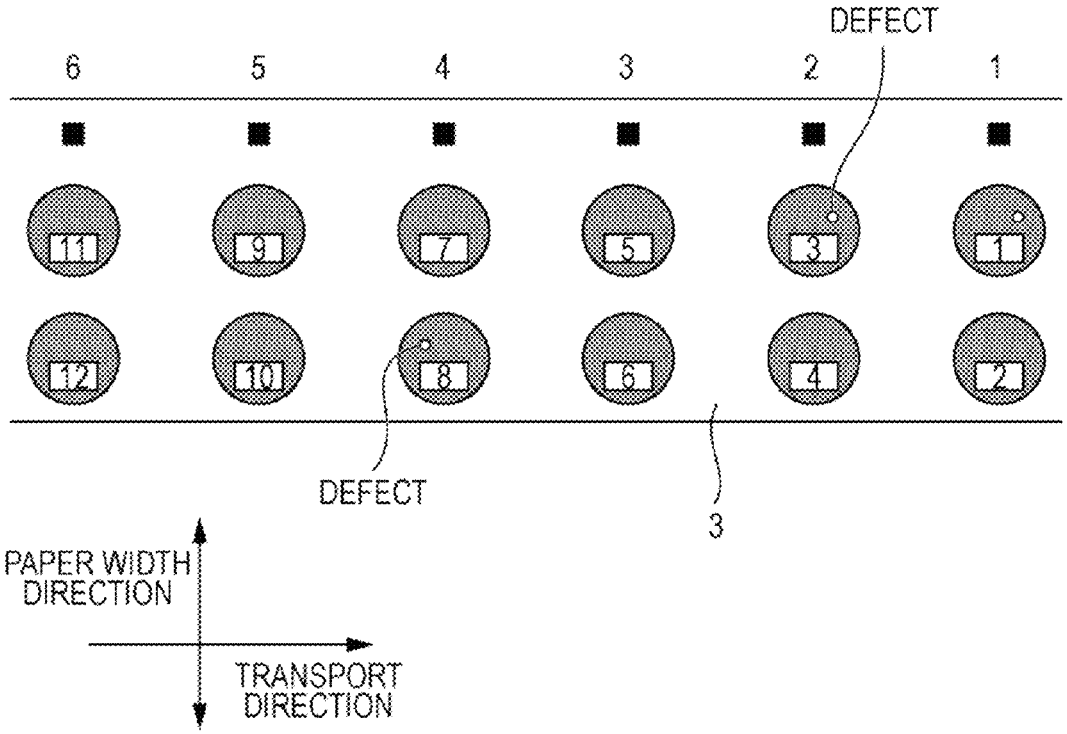
FIG. 12 is a diagram illustrating a printed result in the first embodiment.

FIG. 12 is a diagram illustrating an example of a printed result in the first embodiment. In the drawing, a number (row number) is given to each print operation (print image) of the image data shown in FIG. 7 in series from the downstream side in the transport direction. In FIG. 12, of the images of the second row, the image in the upper stage is defective. Further, of the images of the fourth row, the image in the lower stage is defective.

Figure 13:
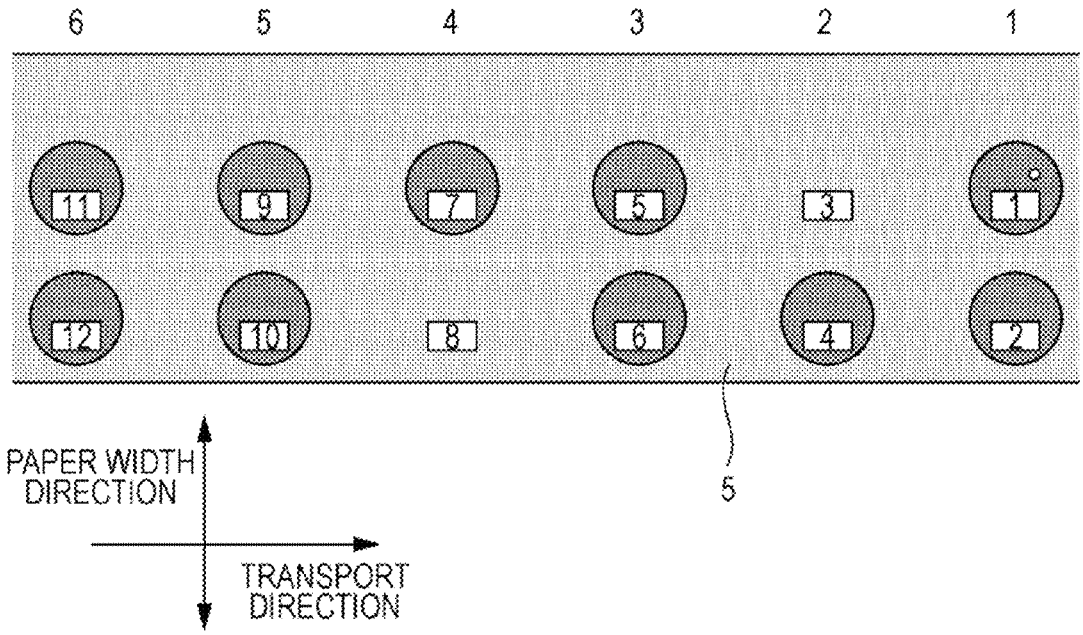
FIG. 13 is a diagram illustrating a state after cutting and unused portion removal have been performed on images shown in FIG. 12 in the first embodiment.

FIG. 13 is a diagram illustrating a state after the cutting and the unused portion removal have been performed on the images shown in FIG. 12 in the first embodiment. In the first embodiment, cutting is performed using one of the cut paths shown in FIGS. 11A through 11C when a defective print is detected. Through this, after the unused portion removal, only a variable image portion is left on the mount 5 at a position of the defectively printed label image. For example, in the case where a label image of the second row in FIG. 12 is cut, since the label image in the upper stage is defectively printed, the cut path shown in FIG. 11A is used. Through this, as for the label image in the upper stage, a portion of the base material 3 where the corresponding variable image portion is formed is cut out from the base material 3 by experiencing the cutting. Meanwhile, as for the label image in the lower stage, a portion of the base material 3 where the label image (the common image portion and the variable image portion) is formed is cut out from the base material 3 by experiencing the cutting. Through this, after the unused portion removal, only the variable image portion is left at a position of the upper stage while the label image (the common image portion and the variable image portion) is left in the lower stage, as shown in FIG. 13. Likewise, as for the fourth row, since the label image in the lower stage is defectively printed, the cut path shown in FIG. 14B is used. Through this, as for the label image in the lower stage, a portion of the base material 3 where the corresponding variable image portion is formed is cut out from the base material 3 by experiencing the cutting. Meanwhile, as for the label image in the upper stage, a portion of the base material 3 where the label image is formed is cut out from the base material 3 by experiencing the cutting. Through this, after the unused portion removal, only the variable image portion is left at a position of the lower stage while the label image (the common image portion and the variable image portion) is left in the upper stage, as shown in FIG. 13.

In the case where a defective print is detected, if the defectively printed image portion is not cut, the whole label image (including the variable image) is separated together with the unused portion by experiencing the unused portion removal. Therefore, when a non-defective label image (including a variable image) is pasted later in place of the defectively printed label image, it is difficult to recognize the position from which the defectively printed label image has been separated and to which a non-defective label image should be pasted. In contrast, in this embodiment, the variable image portion of a defectively printed label image is not removed as an unused portion. Accordingly, in the case where a non-defective label image is pasted later in place of the defectively printed label image, because the variable image portion of the defectively printed label image remains, the variable label image portion of the defectively printed label image to be replaced and the variable image portion of the non-defective label image can be compared with each other. This makes it possible to easily recognize a position to which the non-defective label image should be pasted.

As has been described thus far, the label production apparatus 1 of this embodiment includes the printing unit 13 configured to print a plurality of label images on the base material 3 of the roll paper S, the test unit 20 configured to test the label images printed on the roll paper S, and the post-process unit 30 configured to cut the base material 3 in accordance with test results by the test unit 20. Further, each of the label images printed in this embodiment includes a common image portion which is an image portion common to the plurality of label images and a variable image portion which is an image portion that differs depending on each of the plurality of label images. Furthermore, the post-process unit 30 cuts the base material 3 using a cut path for cutting out, from the base material 3, the common image portion and the variable image portion of a label image that has been detected without any print defect, whereas the post-process unit 30 cuts the base material 3 using a cut path for not cutting out the common image portion from the base material 3 but cutting out, from the base material 3, the variable image portion of a label image that has been detected with a print defect.

Through this, only the variable image portion of a defectively printed label image is left on the mount 5 after the unused portion removal. This makes it possible to simplify the label image pasting work and easily recognize the position for label image pasting.

Second Embodiment

In the first embodiment, one variable image portion is provided to one label image. In a second embodiment of the invention, two variable image portions are provided to one label image. In addition, in the second embodiment, label images are printed through experiencing image attachment. Note that since the configuration of the label production apparatus 1 is the same as that of the first embodiment, description thereof is omitted herein.

Figure 14:
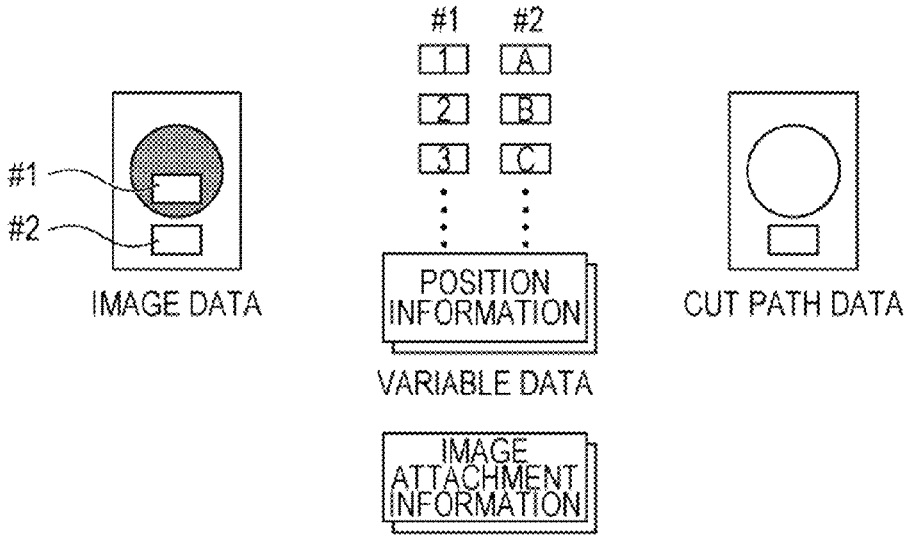
FIG. 14 is a descriptive diagram of data obtained in a print job in a second embodiment of the invention.

FIG. 14 is a descriptive diagram of data obtained in a print job in the second embodiment.

As shown in the drawing, image data and cut path data of the second embodiment are data for one label image. Note that in the second embodiment, image attachment information is also obtained as part of the print job.

In the image attachment information, coordinates (x, y) of a position where the label image is arranged, an image width "w", an image height "h", and so on are included. As for the eye mark, the same types of data are also included therein. These various types of data and the image attachment information are stored in the memory of the controller 50.

Further, in the second embodiment, two kinds of variable image portions including a first (#1) variable image portion and a second (#2) variable image portion are provided. The first variable image portion (1, 2, 3, and so on) is arranged within a label image (common image portion), while the second variable image portion (A, B, C, and so on) is arranged outside the label image (common image portion). Position information of the second embodiment includes information indicating the positions where the first and second variable image portions are respectively arranged.

The cut path data (cut path data of non-defective printing) obtained in the print job is cut path data for cutting the perimeter of a label image (a first variable image portion and a common image portion) and the perimeter of a second variable image portion.

In the second embodiment, the print data generator 12 generates, using the image data and the image attachment information shown in FIG. 14, image data after the image attachment. The cut path generator 31 generates, using the cut path data and the image attachment information shown in FIG. 14, cut path data after the image attachment.

Figure 15:
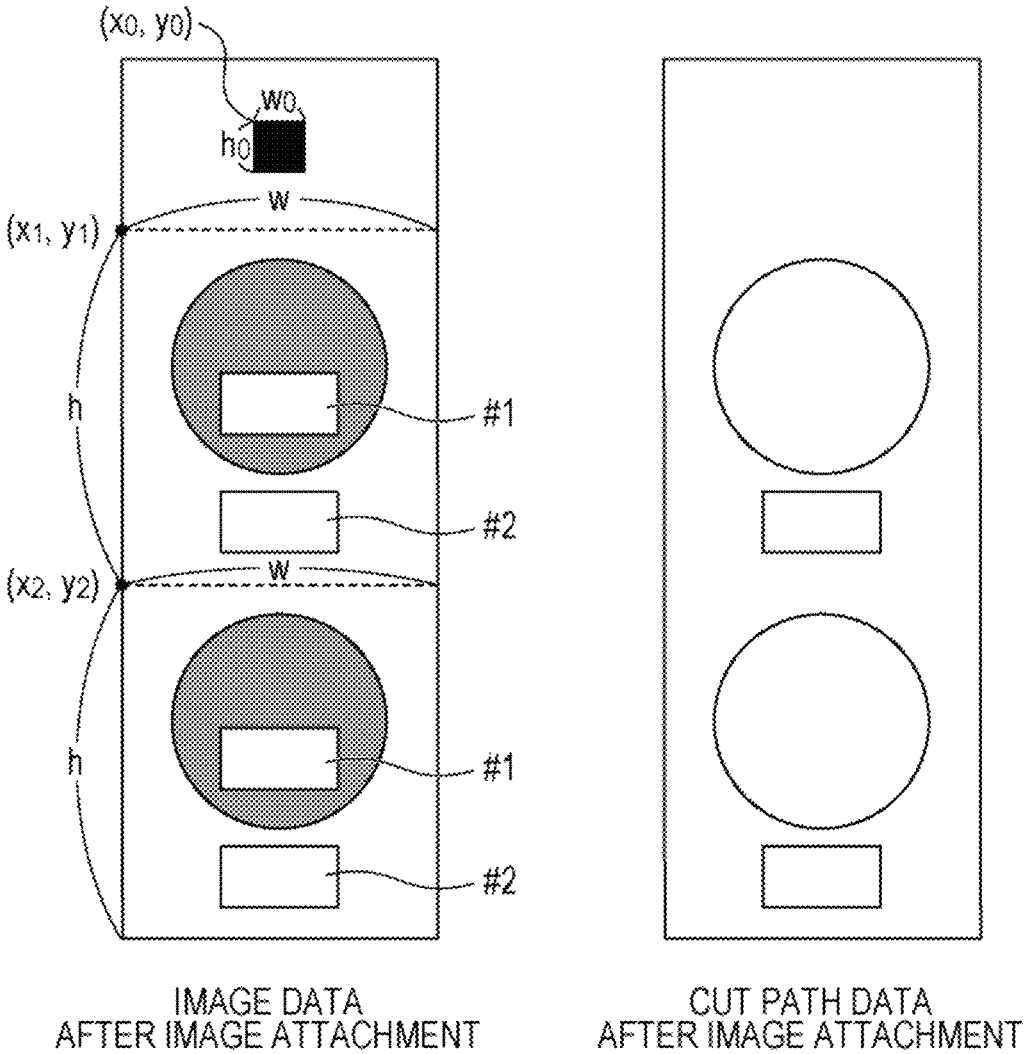
FIG. 15 is a diagram for describing image data and cut path data after image attachment.

FIG. 15 is a diagram for describing image data and cut path data after the image attachment. In the drawing, an x-direction represents the transport direction while a y-direction represents the paper width direction.

The image data will be described first.

For example, the eye mark is arranged, in accordance with the image attachment information, at a position of coordinates $(x_0, y_0)$ having a width "$w_0$" and a height "$h_0$", as shown in FIG. 15. Meanwhile, the image in the upper stage is arranged at a position of coordinates $(x_1, y_1)$ having the width "w" and the height "h", while the image in the lower stage is arranged at a position of coordinates $(x_2, y_2)$ having the width "w" and the height "h". Through this, the same image data as that in FIG. 7 is generated. Note that in this example, $x_2=x_1$, and $y_2=y_1+h$.

The print data generator 12 of the second embodiment, after having generated the image data after the image attachment in the manner described above, generates print data in the same manner as in the first embodiment using the image data after the image attachment. Since the method for generation of the print data is the same as that of the first embodiment, description thereof is omitted.

The cut path generator 31 of the second embodiment performs image attachment of the cut path data using the image attachment information in the same manner as in the case of performing image attachment of the image data, so as to generate cut path data after the image attachment (cut paths of non-defective printing) as shown in FIG. 15. Further, like in the first embodiment, the cut path generator 31 of the second embodiment also generates cut paths of defective printing using the position information (information indicating the positions of the variable image portions).

Figures 16A, 16B, 16C:
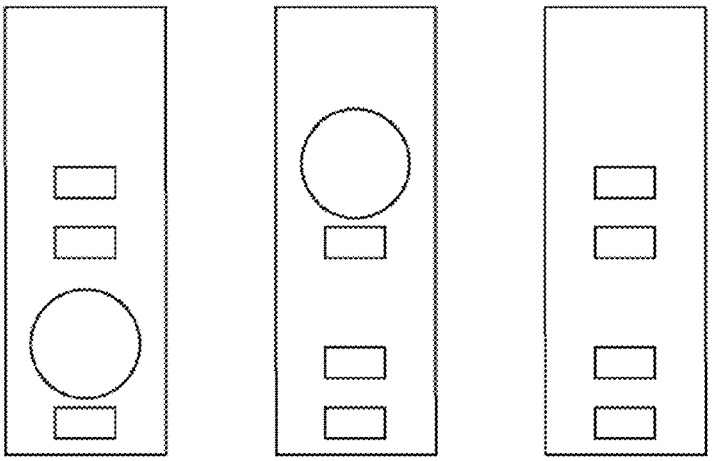
FIGS. 16A through 16C are diagrams for describing cat paths of defective printing generated in the second embodiment.

FIGS. 16A through 16C are diagrams for describing cat paths of defective printing generated in the second embodiment. As shown in the drawings, the cut path data of defective printing is such data that is generated through replacing one of the label image portions of the cut paths shown in FIG. 15 (cut paths after the image attachment) or both the label image portions thereof with a cut path or cut paths for cutting the perimeter of the first variable image portions. Note that the arrangement position of each of the first variable image portions can be obtained from the position information. FIG. 16A is a cut path of a case in which the label image in the upper stage is defective, FIG. 16B is a cut path of a case in which the label image in the lower stage is defective, and FIG. 16C is a cut path of a case in which both the label images in the upper and lower stages are defective. The cut path generator 31 of this embodiment creates the above-described three kinds of data as the cut paths of defective printing.

Figure 17:
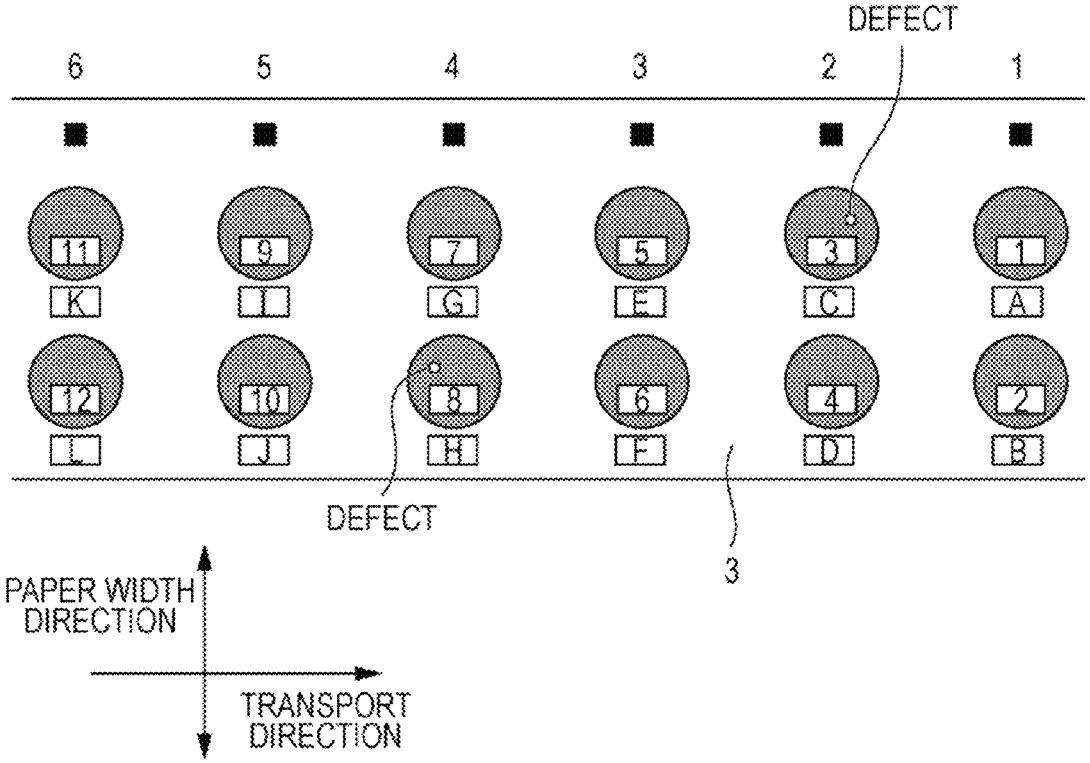
FIG. 17 is a diagram illustrating a printed result in the second embodiment.

FIG. 17 is a diagram illustrating an example of a printed result in the second embodiment. In the drawing, a number (row number) is given to each print operation (print image) of the image data shown in FIG. 15 in series from the downstream side in the transport direction. In FIG. 17, of the images of the second row, the image in the upper stage is defective. Further, of the images of the fourth row, the image in the lower stage is defective.

Figure 18:
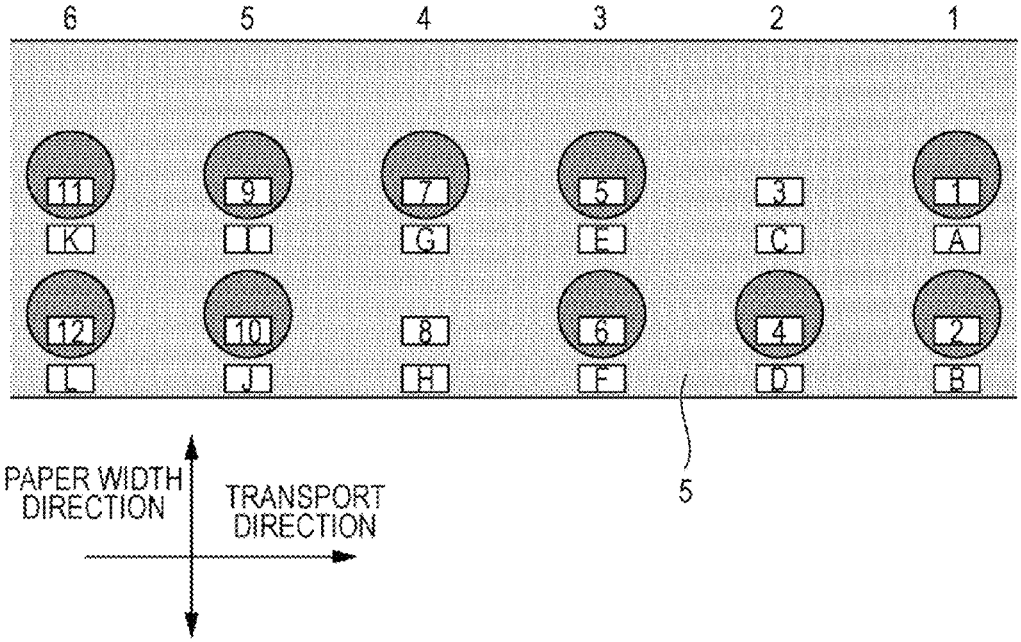
FIG. 18 is a diagram illustrating a state after cutting and unused portion removal have been performed on images shown in FIG. 17 in the second embodiment.

FIG. 18 is a diagram illustrating a state after the cutting and the unused portion removal have been performed on the images shown in FIG. 17 in the second embodiment. In the second embodiment, cutting is performed using one of the cut paths shown in FIGS. 16A through 16C when a print defect is detected. Through this, after the unused portion removal, the first variable image portion and the second variable image portion of the defectively printed label image are left on the mount 5 at a position of the defectively printed label image. For example, in the case where a label image of the second row in FIG. 17 is cut, since the label image in the upper stage is defectively printed, the cut path shown in FIG. 16A is used. Through this, as for the label image in the upper stage, the portions of the base material 3 where the corresponding variable image portions (first and second variable image portions) are formed are cut out from the base material 3 by the cutting. Meanwhile, as for the label image in the lower stage, a portion of the base material 3 where the label image (including the common image portion and the first variable image portion) is formed and a portion thereof where the second variable image portion is formed, are cut out from the base material 3 by the cutting. Through this, after the unused portion removal, only the variable image portions (first and second variable image portions) are left in the upper stage, while the label image (including the common image portion and the first variable image portion) and the second variable image portion are left in the lower stage, as shown in FIG. 18. Likewise, as for the fourth row, since the label image in the lower stage is defectively printed, the cut path shown in FIG. 16B is used. Through this, as for the label image in the lower stage, the portions of the base material 3 where the corresponding variable image portions (first and second variable image portions) are formed are cut out from the base material 3 by the cutting. Meanwhile, as for the label image in the upper stage, a portion of the base material 3 where the label image (including the common image portion and the first variable image portion) is formed and a portion thereof where the second variable image portion is formed, are cut out from the base material 3 by the cutting. As a result, after the unused portion removal, the label image (including the common image portion and the first variable image portion) and the second variable image portion are left in the upper stage, whereas only the variable image portions (first and second variable image portions) are left in the lower stage, as shown in FIG. 18.

Third Embodiment

In the second embodiment, the first variable image portion and the second variable image portion are both left on the mount 5 when a label image is defectively printed. In a third embodiment of the invention, a variable image portion to be left on the mount 5 can be selected when a label image is defectively printed. Note that the images printed in the third embodiment are the same as those printed in the second embodiment.

In the label production apparatus 1 of the third embodiment, it is possible for the operator to specify a variable image portion to be left when a label image is defectively printed via an input screen (not shown). For example, the following are provided as choices: that is, to leave only the first variable image portion, to leave only the second variable image portion, or to leave both of them. The operator specifies which of the first and second variable image portions should be left.

Here, it is assumed that only the second variable image portion is specified to be left when a label image is defectively printed.

Figure 19:
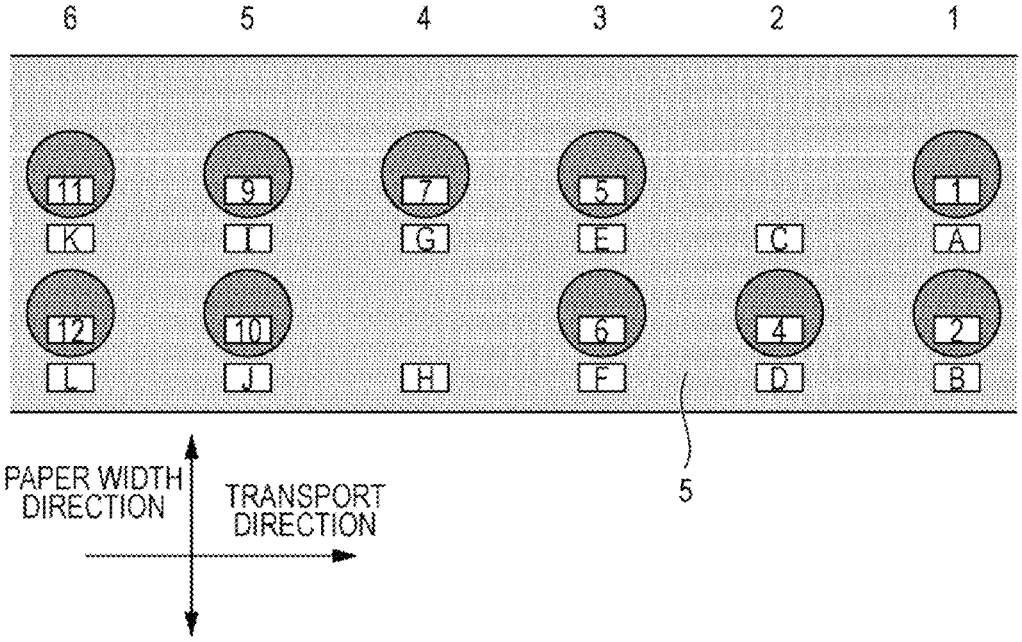
FIG. 19 is a diagram illustrating a state after cutting and unused portion removal have been performed on the images shown in FIG. 17 in a third embodiment of the invention.

FIG. 19 is a diagram illustrating a state after the cutting and the unused portion removal have been performed on the images shown in FIG. 17 in the third embodiment.

In this example, it is specified that only the second variable image portion is left. Because of this, generated is cut path data for not cutting a label image including the first variable image portion when the label image is defectively printed. When a print defect is detected, by performing the cutting using the generated cut path data and thereafter performing the unused portion removal, only the second variable image portion is left on the mount 5. For example, in FIG. 19, only the second variable image portions are left at the positions of the defectively printed label images shown in FIG. 17 (that is, the upper stage of the second row and the lower stage of the fourth row).

As described above, in the case where a plurality of variable images are provided to a single label image, at least one of the plurality of variable images may be left (cut out from the base material 3) when a print defect is detected. In this case, it is possible to enhance the easiness of label image pasting work.

Although only the second variable image portion is left in the third embodiment, only the first variable image portion may be left instead. Further, although, in the second and third embodiments, the first variable image portion is included in the common image portion while the second variable image portion is not included in the common image portion, the invention is not limited thereto. For example, both the first and second variable image portions may be included in the common image portion. Alternatively, neither the first variable image portion nor the second variable image portion may be included in the common image portion.

Other Embodiments

The above embodiments are given so as to facilitate understanding of the invention, and are not intended to limit the interpretation of the invention. This invention can be modified or improved without departing from the spirit of the invention, and it is needless to say that those equivalent entities are included in this invention. In particular, embodiments described hereinafter may be also included in this invention.

Printing Section 13

In the above embodiments, although the printing section 13 is a line printer, the invention is not limited thereto. For example, such a printer may be employed as the printing section 13 that has a plurality of heads disposed facing a circumferential surface of a cylindrical transport drum and discharges ink from the heads toward a medium while transporting the medium along the circumferential surface of the transport drum so as to form an image on the medium. In addition, for example, the printing section 13 may be a printer (lateral printer) that repeats operation of discharging ink toward a medium that has been transported to a printing region while moving a head of the printer along a transport direction of the medium as well as operation of moving the head in a width direction of the medium so as to form an image in the printing region, thereafter transports a portion of the medium on which printing has not been performed to the printing region.

Discharge Technique

The technique of discharging ink from a head may be a technique that discharges ink using a piezoelectric element (piezo element) or a technique that discharges ink using bubbles generated by heat in a nozzle. Other techniques may be used as well.

Medium

Although, as an example of a medium, roll paper S is cited and described in the above embodiments, the invention is not limited thereto. It is sufficient that the medium is formed of three layers including the base material 3, the adhesive layer 4 and the mount 5. For example, the medium may be a cut paper. Further, the materials of the three layers are not limited to any specific ones. The base material 3 may be a film, for example.

Ink

As inks for color images, although the four color inks of cyan, magenta, yellow, and black are used in the above embodiments, other color inks (for example, light cyan, light magenta, and the like) may be additionally used.

A UV curing ink that hardens when being irradiated with ultraviolet light (UV) may be used. In this case, by providing a light source for emitting UV at the downstream side of each of the heads in a medium transport direction and irradiating a medium with the UV on which dots have been formed, the dots can be fixed on the medium. Accordingly, printing can be favorably performed even on a medium which is unlikely to absorb ink.

Label Image

Although a circular figure is printed as a label image in the above embodiments, the invention is not limited thereto. Other figures, pictures, symbols (characters), and the like may be printed. Further, in the above embodiments, although two label images are arranged in the paper width direction, the invention is not limited thereto. For example, three or more label images may be arranged and aligned in the paper width direction.

Test Unit 20

Although, in the above embodiments, the scanner 21 is used to test whether or not a label image is non-defective, the invention is not limited thereto. For example, such a technique may be employed that detects a defect portion (ink not being discharged) in real time by an electric signal of residual vibration of the head at a time of ink discharge.

Post-Process Unit 30

Although, in the above embodiments, the post-process unit 30 includes the cutting section 32 and the unused portion remover 35, the invention is not limited thereto. For example, the unused portion remover may be provided as a separate device (different entity) and may only perform removing an unused portion of the roll paper S that has experienced the cutting.

Variable Image

In the above embodiments, data of the variable images includes images (characters), and a csv file in which information describing the above images (characters) is stored is inputted; however, the invention is not limited thereto. The data may be described in the form of text, for example, or in other forms than the form of text. Further, information on the arrangement positions of the variable images may be specified in the form of a general variable format (PPML: Personalized Print Mark-up Language) or the like.

The entire disclosure of Japanese Patent Application No. 2013-068823, filed Mar. 28, 2013 is expressly incorporated by reference herein.

What is claimed is:

1. A label production apparatus comprising:

a printing unit configured to print a plurality of label images on a first base material included in a print target medium that has the first base material, a second base material, and an adhesive layer interposed between the first base material and the second base material;

a test unit configured to test the label images printed on the print target medium; and a post-process unit configured to cut the first base material, and a controller configured to control cutting by the post-processing unit in accordance with the tests results by the test unit, wherein each of the label images includes a common image portion which is an image portion common to the plurality of label images and a changeable image portion which is an image portion that differs depending on each of the plurality of label images, wherein, the controller controls the post-process unit to cut the first base material using a first cut-line for cutting out, from the first base material, the common image portion and the changeable image portion of the label image that has been detected to have no print defect by the test unit, and the controller controls the post-process unit to cut the first base material using a second cut-line for cutting out from the first base material at least part of the changeable image portion of the label image when the test unit detects a print defect in the label image wherein the changeable image portion remains on the second base material and the common image portion is removed from the second base material when the common image portion includes the defect.

2. The label production apparatus according to claim 1, wherein each of the label images includes a plurality of the changeable image portions.

3. The label production apparatus according to claim 2, wherein the changeable image portion to be cut out from the first base material can be selected among the plurality of changeable image portions when the second cut-line is used.

* * * * *